US006776620B2

(12) United States Patent
Noda

(10) Patent No.: US 6,776,620 B2
(45) Date of Patent: Aug. 17, 2004

(54) RIGHT-ANGLE COAXIAL CONNECTOR

(75) Inventor: Atsuhito Noda, Hachioji (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/051,579

(22) Filed: Jan. 18, 2002

(65) Prior Publication Data

US 2002/0098720 A1 Jul. 25, 2002

(30) Foreign Application Priority Data

Jan. 19, 2001 (JP) ..... 2001-012047

(51) Int. Cl.[7] ..... H01R 12/00

(52) U.S. Cl. ..... 439/63; 439/582; 439/675; 439/606

(58) Field of Search ..... 439/63, 581, 582, 439/606, 675

(56) References Cited

U.S. PATENT DOCUMENTS 4,453,796 A * 6/1984 Monroe ..... 439/581
4,548,453 A * 10/1985 Mummey et al. ..... 439/55
4,889,500 A * 12/1989 Lazar et al. ..... 439/364
5,120,258 A * 6/1992 Carlton ..... 439/581
5,842,872 A * 12/1998 Hosler et al. ..... 439/63
5,961,355 A * 10/1999 Morlion et al. ..... 439/686
6,079,986 A * 6/2000 Beshears ..... 439/581

* cited by examiner

*Primary Examiner*—P. Austin Bradley
*Assistant Examiner*—Edwin A. Leon
(74) *Attorney, Agent, or Firm*—Robert J. Zeitler

(57) ABSTRACT

A right-angle coaxial connector is provided, which can eliminate a possibility of the electric short circuit, which is excellent in mass production applicability, and which can be manufactured with low cost. The right-angle coaxial connector includes a coaxial plug 10 provided at an end of a cable 1, and a coaxial receptacle 20 electrically connected to the coaxial plug by inserting the coaxial plug therein. The coaxial plug 10 includes a plug main body 11 made of an insulative resin, and a plurality of pin type terminals protruded from a surface of the plug main body. The pin type terminals are divided into one signal terminal 12 and a plurality of ground terminals 13 disposed around the signal terminal. The ground terminals 13 are preferably arranged such that distances between adjacent ground terminals are set to be equal to one another.

11 Claims, 8 Drawing Sheets

RIGHT-ANGLE COAXIAL CONNECTOR

BACKGROUND OF THE INVENTION

The present invention relates to a technology of a right-angle coaxial connector in which a pin-type terminal on a coaxial plug provided at an end of a cable is oriented in a direction different by 90 degrees from an axial direction of the cable.

The right-angle coaxial connector includes a coaxial plug and a coaxial receptacle. The coaxial plug is used, for example, such that the coaxial plug is provided at an end of a coaxial cable. The coaxial receptacle is used, for example, such that the coaxial receptacle is mounted to a board or the like.

In association with recent tendency toward small-size and light-weight electronic equipments, rapid progress has been made in miniaturizing coaxial connectors per se. Japanese Utility Model Application Laid-open No. Hei 5-33481 discloses particularly a technology of a right-angle coaxial connector, in which the thickness of a coaxial plug can be reduced particularly. Japanese Patent Application Laid-open No. Hei 5-266951 discloses a technology that can suppress the height of a fitting portion of a coaxial connector with a simple construction.

The right-angle coaxial connectors of this type are, in general, designed such that a ground terminal of a coaxial plug is constructed by a metal shell as disclosed by these publications. For example, a fitting portion of the coaxial plug to the coaxial receptacle is provided with a signal terminal connected to a central conductor of a cable, and a ground terminal made up of a metal shell connected to an outer conductor of the cable. The ground terminal is formed into a cylindrical shape surrounding the signal terminal, and formed of electrically conductive metal throughout.

On the other hand, the coaxial receptacle is provided with a recessed portion (a hole) into which the signal terminal of the coaxial plug and the cylindrical grand terminal thereof are insertable entirely. Within the recessed portion, signal contacts are provided to be electrically connected with the signal terminal and the ground terminals through contact.

The coaxial plug in the prior art may encounter the following problems in relation to the construction in which the metal shell serving also as the ground terminal is in the form of the cylindrical shape surrounding the signal terminal and formed of the electrically conductive metal throughout.

For example, when the coaxial receptacle is mounted to a board, or the coaxial plug is connected to the coaxial receptacle, electrically conductive metal wastes and so on may find their way into the connected portion (fitting portion) therebetween for some reason. In the case where the metal wastes are in the connected portion, there is a possibility that a short circuit occurs between the signal terminal and the metal shell. This problem becomes more serious as the connector is reduced in size, and a countermeasure against this problem is required. In particular, in a case of a super-miniature connector whose coaxial plug is several millimeters in diameter, there is a high possibility that a short circuit occurs between the signal terminal and the metal shell due to the metal dust, particles or the like, and thus the countermeasure for preventing this is important.

In the coaxial plug of the prior art, a metal plate is processed into a cylindrical shape to form the ground terminal serving also as the metal shell, and therefore there arises another problem in that the mass production applicability is low and the cost is high.

Accordingly, an object of the present invention is to provide a right-angle coaxial connector which can eliminate a possibility of electrical short circuits, and which is excellent in mass production applicability, and which can be manufactured with low cost.

SUMMARY OF THE INVENTION

A coaxial connector for right-angled connection according to the present invention comprises a coaxial plug provided at an end of a cable, and a coaxial receptacle electrically connected to the coaxial plug by inserting the coaxial plug therein, characterized in that: the coaxial plug includes a plug main body made of an insulative resin, and a plurality of pin type terminals protruded from a surface of the plug main body; and the pin type terminals are divided into one signal terminal and a plurality of ground terminals disposed around the signal terminal.

According to the present invention, the coaxial plug has one signal terminal and the plurality of ground terminals disposed around the signal terminal, and these terminals are each in the form of the pin type, and protrudes from the surface of the insulative plug main body. In particular, the ground terminal is not the cylindrical, but rather is a pin type in contrast to the prior art, and therefore clearances are formed between the terminals. Consequently, even if metal waste, particles, and the like find their way into the clearances between the terminals, they can easily pass through the clearances and they can be removed easily therefrom. Accordingly, the possibility of electric short circuits can be eliminated. Further, the entire housing is formed of resin, and a ground terminal serving also as a metal shell, which is low in productivity, is not used. Accordingly, the mass production applicability is improved, and manufacture with low cost can be realized.

It is preferable that the ground terminals of the invention are arranged such that distances between adjacent ground terminals are also equal to each other. By setting the clearances between adjacent terminals equal, the electric field distribution around the signal terminal can be made uniform, and the shielding effect by the ground terminals can be enhanced.

It is preferable that the ground terminals are arranged such that distances from the signal terminal to the ground terminals are also equal to one another. By setting the distances from the signal terminal to the ground terminals to be equal to one another, the electric field distribution around the signal terminal can be made more uniform, and the shielding effect by the ground terminals can be enhanced.

In another embodiment of the invention, a surface of the plug main body is partially formed into a planar surface extending in an axial direction of the cable and the signal terminal is disposed at a central portion of the planar surface protrudes from the planar surface, while the ground terminals are disposed around the signal terminal. By arranging the terminals on the planar surface extending in the axial direction of the cable to be protruded from the planar surface, the form of the right-angle coaxial plug can be maintained, while a simple arrangement that makes it difficult for the metal wastes to enter into or to stay in the clearances between the terminals can be realized.

As least two or more ground terminals are preferably used. However, from the viewpoint of controlling the electric field distribution by the ground terminals, in a case where the two ground terminals are provided, it is preferable that the two ground terminals are disposed to be point-symmetric with respect to the signal terminal. In a case where three ground terminals are provided, it is preferable that the ground terminals are disposed at respective apex positions of a regular imaginary triangle with the signal terminal inside of the triangle.

Where four ground terminals are provided, it is preferable that the ground terminals are disposed at respective corner portions of an imaginary square centered around the signal terminal. Where eight ground terminals are provided, it is preferable that the ground terminals are respectively disposed at corner portions of an imaginary square centered about the signal terminal and at middle points of the sides of the imaginary square.

In another embodiment, the coaxial receptacle includes an insulative housing having a surface formed with a plurality of guide holes into which the signal and ground terminals are respectively inserted, and a plurality of contacts disposed within the guide holes of the insulative housing. The receptacle contacts include a signal contact contacted with the plug, signal terminal and a plurality of ground contacts contacted with the plug ground terminals. The surface of the insulative housing has a planar portion surface-contacted with the planar surface of the coaxial plug.

By providing the coaxial receptacle with the plurality of guide holes independently and respectively corresponding to the signal and ground terminals, even if minute metal wastes and so on find their way into the guide holes, a short circuit between the signal terminal and the ground terminal will not occur. Since the surface of the insulative housing has a planar portion, it can be contacted with the planar surface of the coaxial plug, thereby preventing the formation of a clearance between the receptacle and the plug.

In another embodiment, can also be used in which the insulative housing of the coaxial receptacle has a side surface intersecting the surface thereof, and a stopper portion is provided in a boundary portion to the planar surface of the plug main body so as to be contacted with the side surface of the insulative housing, thereby restricting a displacement of the plug main body in a direction about an axis of the signal terminal when the coaxial plug is connected to the coaxial receptacle. This construction makes it possible to reliably position the coaxial plug with respect to the coaxial receptacle, and maintain the excellent connected state therebetween.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Hereafter, a first embodiment of the present invention will be described with reference to FIGS. 1 to 6.

Figure 1:
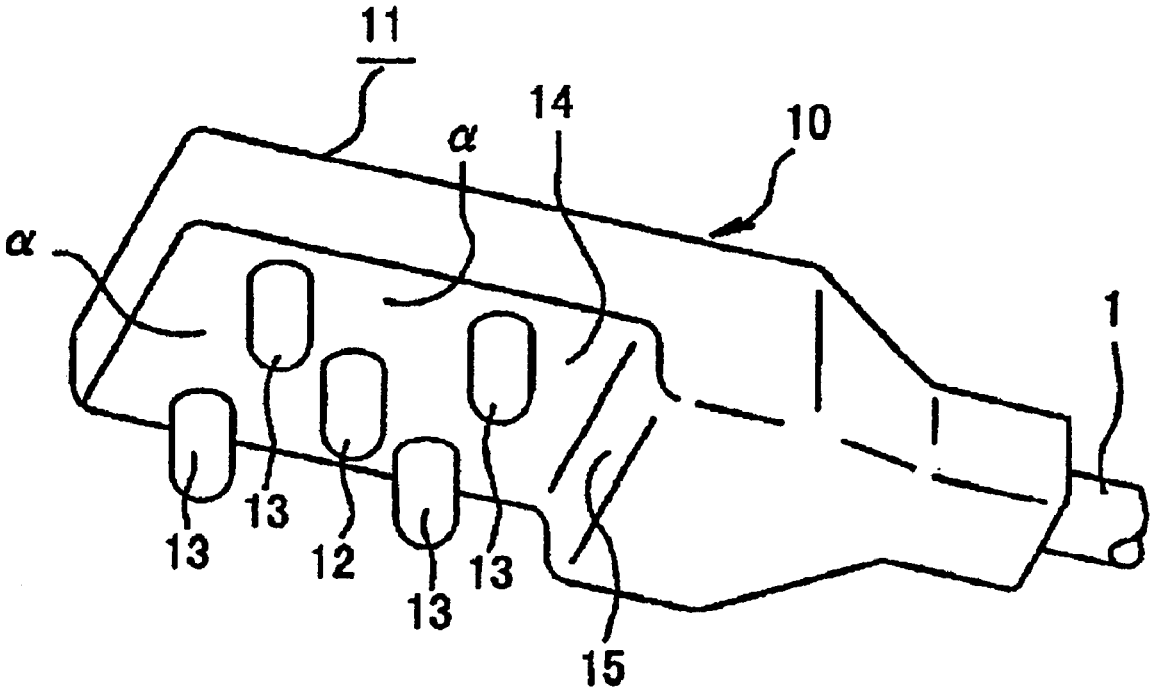
FIG. 1 is a perspective view of a coaxial plug, showing an embodiment of the present invention.
Figure 2:
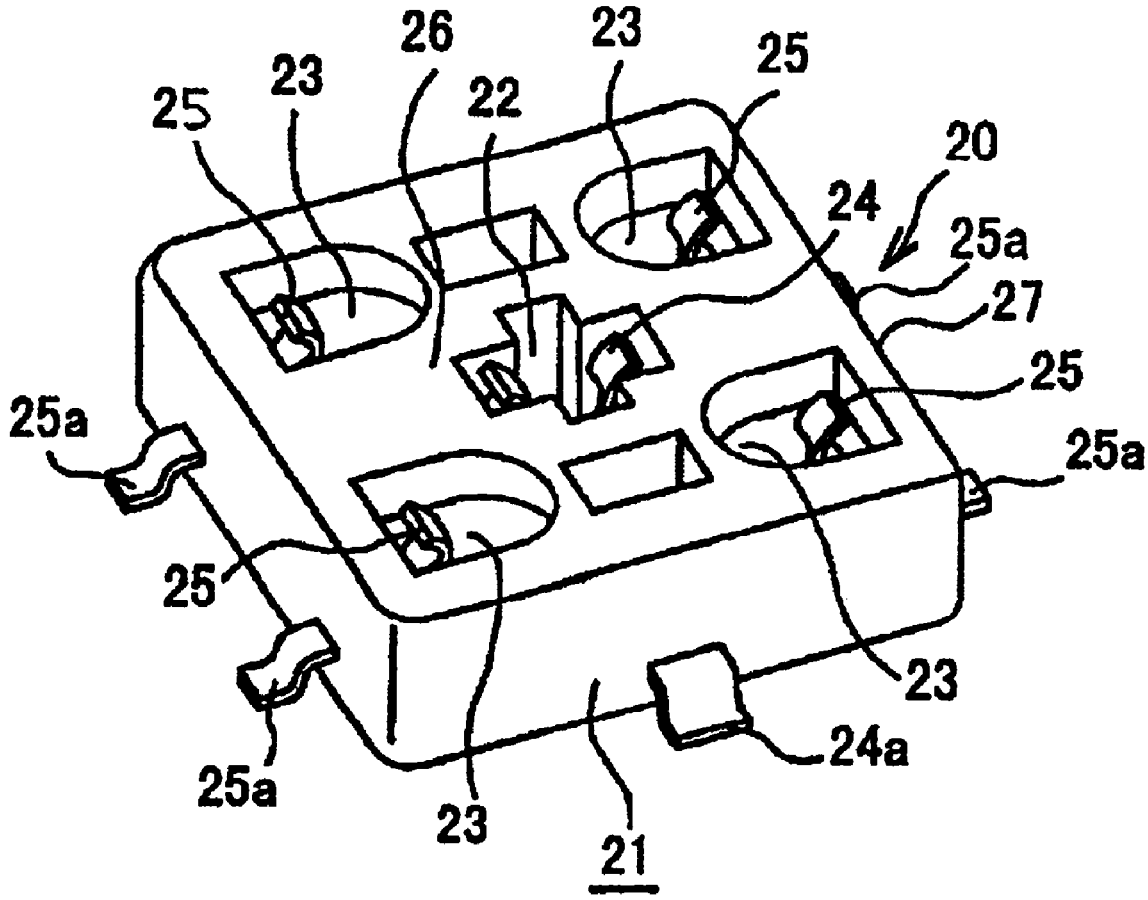
FIG. 2 is a perspective view of a coaxial receptacle, showing the embodiment of the present invention.

In the first embodiment, a miniature right-angle coaxial connector is shown. FIG. 1 is a perspective view of a coaxial plug, and FIG. 2 is a perspective view of a coaxial receptacle. The plug and receptacle are engageable together.

Figure 4:
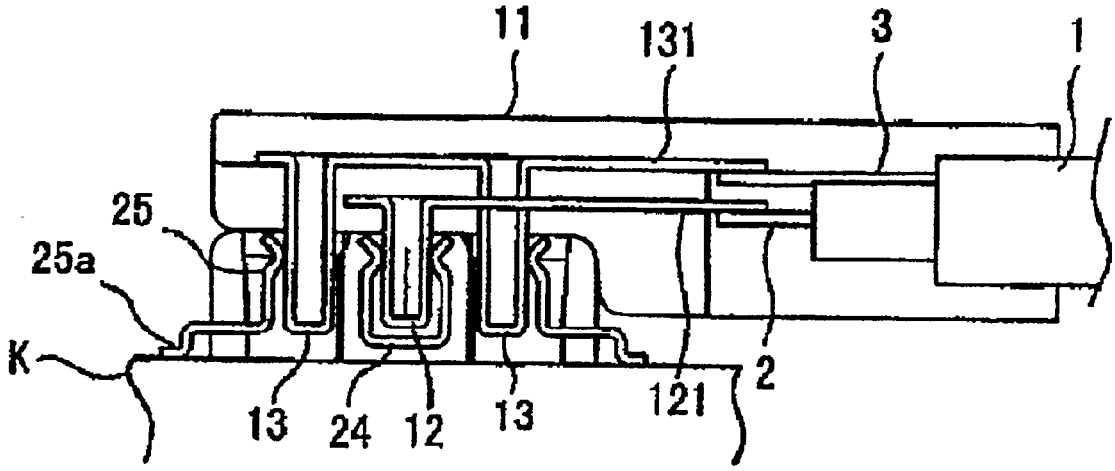
FIG. 4 is a sectional view of a right-angle coaxial connector, showing the embodiment of the present invention.
Figure 5:
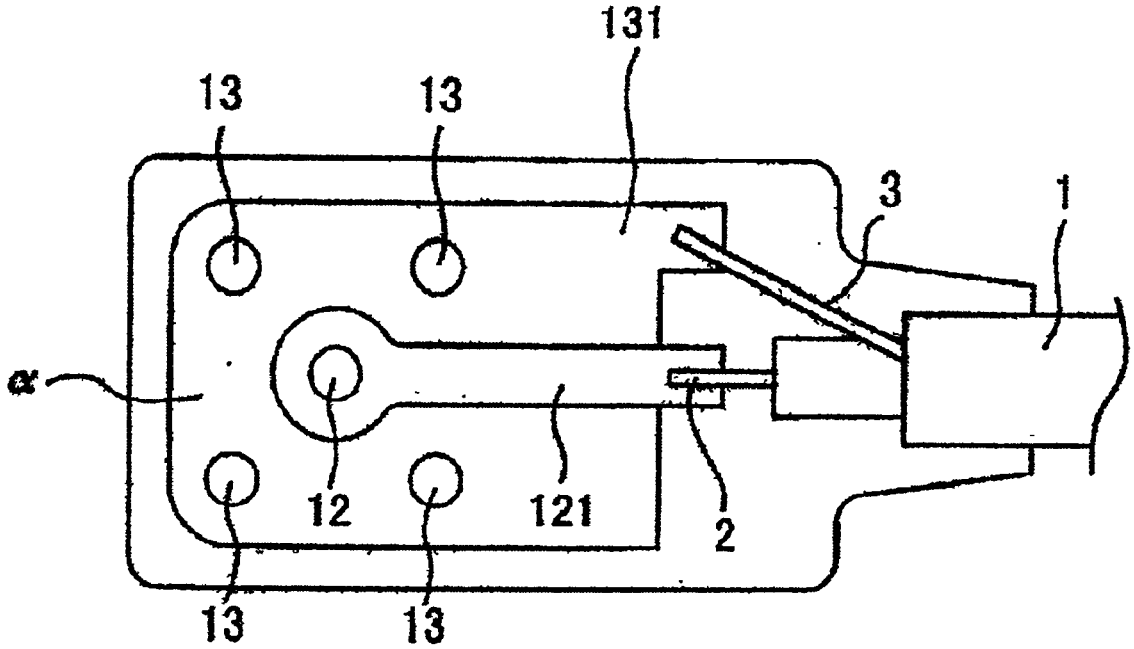
FIG. 5 is a bottom view showing a construction of a pin type terminal of the coaxial plug, showing the embodiment of the present invention.

The right-angle connector shown in these drawings is provided with a coaxial plug 10 provided at an end of a cable 1, and a coaxial receptacle 20 electrically connected to the coaxial plug 10 by inserting the coaxial plug 10 thereto. As shown in FIGS. 1, 4 and 5, the coaxial plug 10 has a plug main body 11 made of an insulative resin, and a plurality of pin type terminals 12 and 13 protruded from a surface of the plug main body 11. The plug main body 11 serves also as a housing of the coaxial plug 10.

The tapered pin type terminals 12 and 13 are classified into one signal terminal 12 and a plurality of ground terminals 13 disposed around the signal terminal 12. A part of the surface of the plug main body 11 is formed as a planar surface 14 extending in the axial direction of the cable 1. The signal terminal 12 is arranged in a central portion of the planar surface 14 so as to be protruded from the planar surface 14, and four ground terminals 13 are arranged around the signal terminal 12.

Figure 6:
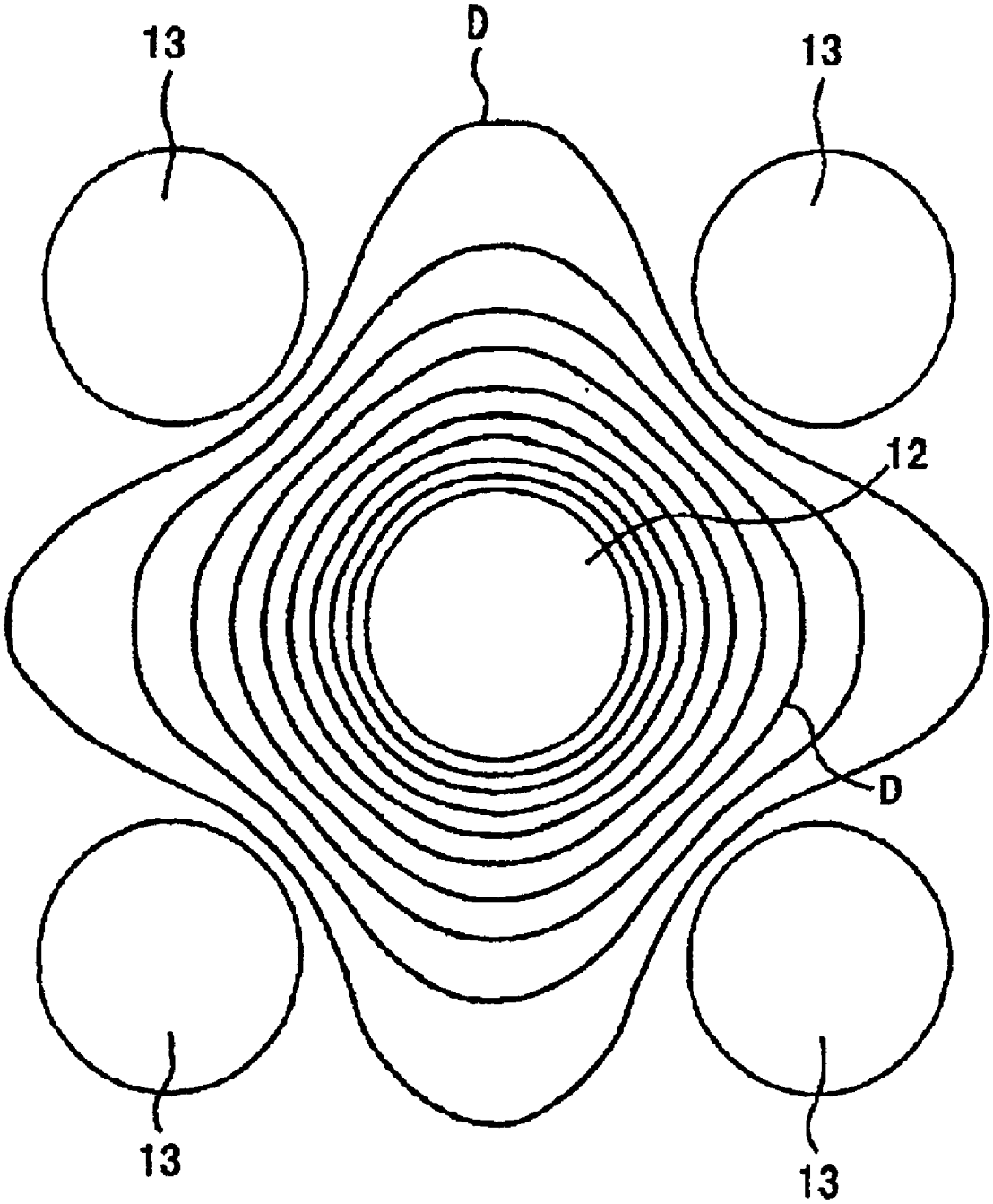
FIG. 6 is an explanatory view showing an electric field distribution of the coaxial plug, showing the embodiment of the present invention.

As shown in FIGS. 5 and 6, the four ground terminals 13 are arranged such that the distance between every adjacent ground terminals 13 are preferably the same. Further, distances from the ground terminals 13 to the central signal terminal 12 are also preferably equal to each other. In a case where the four ground terminals 13 are arranged in this manner, it is preferable to arrange the ground terminals, as shown in FIGS. 1 and 5 at respective corner portions of an imaginary square that is centered about the signal terminal 12. (This imaginary square will be formed by imaginary lines connecting the ground terminals 13).

The coaxial receptacle 20 (FIGS. 2 and 3) includes an insulative housing 21 having a surface provided with a plurality of cavitites 22 and 23 into which the signal terminal 12 and the ground terminals 13 are inserted, respectively. The cavity 22 is arranged at the center of the housing 21, and the guide holes 23 are provided around the guide hole 22. The central cavity 22 ha a signal contact 24 to be contacted with the signal terminal 12, and ground contacts 25 to be contacted with the respective ground terminal 13 is disposed within each of the surrounding four guide holes. A planar portion 26 is formed on the surface of the insulative housing 21 to be surface-contacted with the planar surface 24 of the coaxial plug.

The insulative housing 21 of the coaxial receptacle 20 has a side surface 27 (FIG. 2) intersecting the surface (planar portion 26) thereof This side surface 27 is one of the four side surfaces of the insulative housing 21 formed into a box shape of substantially square in shape. A solder tail 24*a* of the signal contact 24 is protruded from one side surface of the insulative housing 21, and solder tails 25*a* of the ground contacts 25 are protruded from other two side surfaces thereof These solder tails are soldered to a signal electrode and ground electrodes of a board K when the coaxial receptacle 20 is mounted to the board K (see FIG. 4).

On the other hand, a stop wall 15 is provided at a boundary with respect to the planar surface 14 of the plug main body 11 to be contacted with an opposing side surface 27 when the coaxial plug 10 is mated to the coaxial receptacle 20 (FIG. 4). The stop wall 15 forms a detent in the plug that is designed to be surface-contacted with the side surface 27. This restricts rotational displacement of the coaxial plug 10 in a direction about an axis of the signal terminal 12, whereby the coaxial plug 10 can be connected to the coaxial receptacle 20 in a stable state.

The internal construction of the coaxial plug 10 and coaxial receptacle 20 is shown in FIGS. 4 and 5. As can be seen from these drawings, the signal terminal 12 and the ground terminals 13 are all formed by subjecting a metal plate to a forming to have a tapered pin shape. The signal terminal 12 is formed in one end side of an elongated metal plate 121. Onto the other end side of the elongated metal terminal 121, a central conductor 2 of the cable 1 is connected by means of soldering, ultrasonic welding, electrode welding or the like. The ground terminals 13 are formed integrally from a single wide metal plate 131. An outer conductor 3 of the cable 1 is connected to the wide metal plate 131 by the same means as the case of the central conductor 2.

The elongated metal plate 121 and the wide metal plate 131 are disposed to have a level difference in the thickness direction of the plug main body 11 so as to avoid the short circuit. The plug main body 11 serving also as the housing of the coaxial plug 10 is made of an insulative resin. The insulative housing 21 of the coaxial receptacle 20 is also made of an insulative resin.

Figure 3:
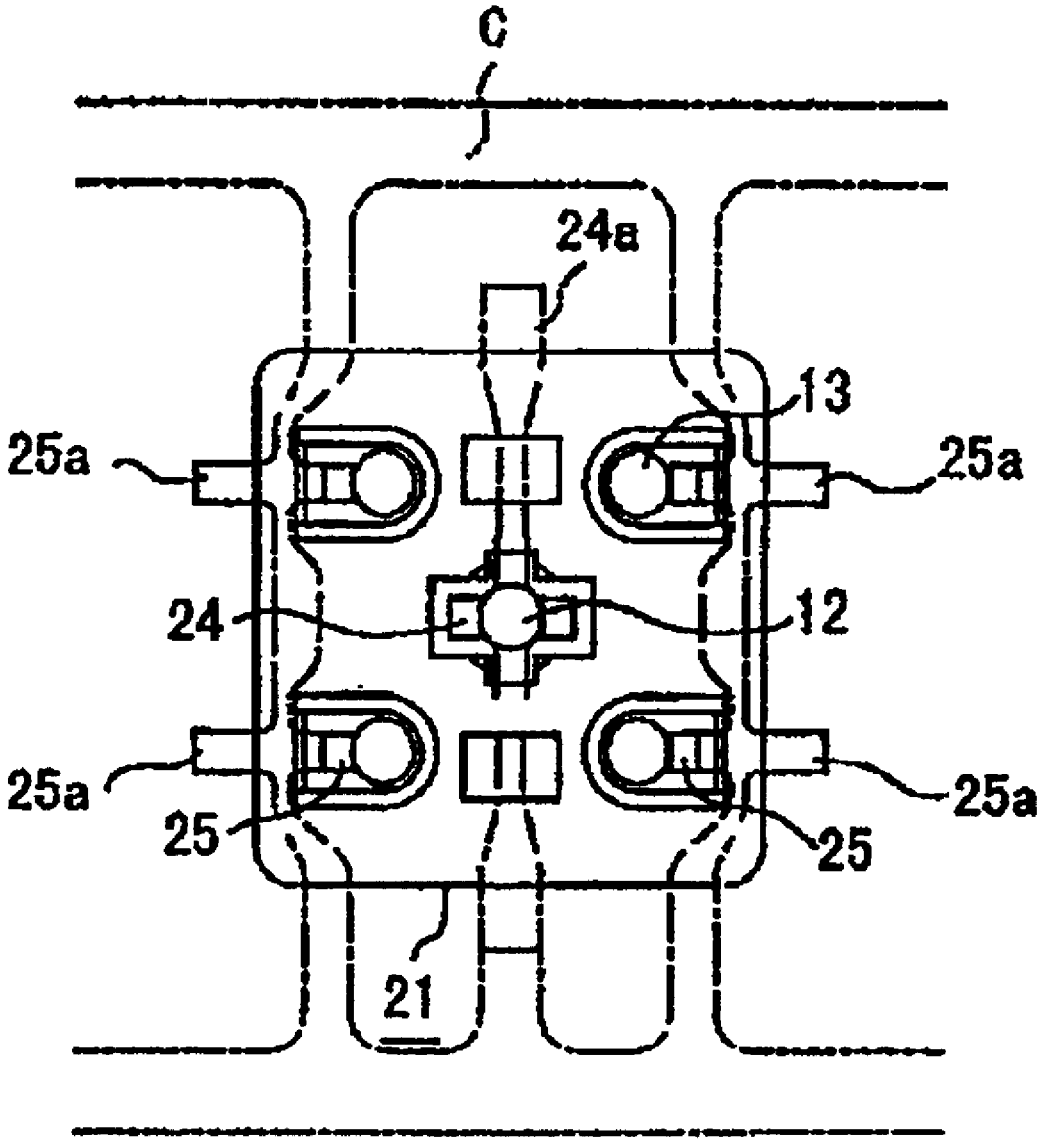
FIG. 3 is a plan view showing a molding technique for the coaxial receptacle, showing the embodiment of the present invention.

For the insulative resin of the insulative housing 21, a method shown in FIG. 3 can be adopted. That is, the signal contact 24 and the ground contacts 25 are manufactured in the form having a double carrier C using a contact processing technology. Further, by a molding technology using dies, the insulative housing 21 is molded while this double carrier C remains. That is, each of the coaxial plug 10 and the coaxial receptacle 20 is formed by overmolding.

According to this embodiment, the coaxial plug 10 made of the insulative resin has the one signal terminal 12 protruded from the surface of the plug main body 11 made of an insulative resin, and the four ground terminals 13 disposed therearound, each of the terminals being of a pin type. In particular, since the ground terminal 13 is not of a cylindrical type of the prior art but the pin type, clearances a are formed between the terminals 12 and 13. Consequently, even if metal waste, particles, and the like find their way into the clearances or between the terminals 12 and 13, they can easily pass through the clearance to be removed therefrom. Accordingly, the possibility of the electric short circuit can be eliminated. Further, the socket main body 11 serving also as the entire housing is formed of resin, and a ground terminal serving also as a metal shell, which is low in productivity, is not used. Accordingly, the mass production applicability is improved, and manufacture with low cost can be realized.

Since the ground terminals 13 are disposed at four locations around the signal terminal 12, an electric field D generated with respect to the signal terminal 12 as a reference is as shown in FIG. 6. As can be seen from FIG. 6, a sufficient shielding effect by the four ground terminals 13 can be expected.

The terminals 12 and 13 are arranged on the planar surface 14 extending along the axial direction of the cable 1 to be protruded from the planar surface 14. Therefore, the form of the right-angle coaxial plug can be maintained while a simple arrangement that makes it difficult for the metal wastes to enter into or to stay in the clearances between the terminals 12 and 13 can be realized.

The plurality of guide holes 22 and 23 are independently provided in the coaxial receptacles 20 to respectively correspond to the signal terminal 12 and the ground terminals 13. Therefore, even if minute metal waste and so on find their way into the guide holes, the short circuit between the signal terminal 12 and the ground terminal 13 does not occur. Since the surface of the insulative housing 21 has the planar portion 26, it can be surface-contacted with the planar surface 14 of the coaxial plug 10, thereby preventing the formation of a clearance between the receptacle 20 and the plug 10. Consequently, the total thickness of the receptacle 20 and the plug 10 in the connected state can be made thin.

The insulative housing 21 of the coaxial receptacle 20 has the side surface 27 intersecting the surface thereof, and the stopper portion 15 is provided in the boundary portion to the planar surface 14 of the plug main body 11 so as to be contacted with the side surface 27 of the insulative housing 21 and restrict the displacement of the plug main body 10 in the direction about the axis of the signal terminal 12 when the coaxial plug 10 is connected to the coaxial receptacle 20. This makes the positioning of the coaxial plug 10 with respect to the coaxial receptacle 20 reliable, and the excellent connected state therebetween can be maintained.

Figure 7:
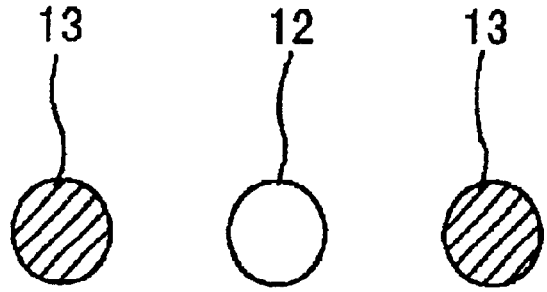
FIG. 7 is an arrangement view of pin type terminals, showing a second embodiment of the present invention.

In the invention, it is desired to have at least two ground terminals provided. However, from the viewpoint of controlling the electric field distribution by the ground terminals, it is desirable to consider the following points. In a case where two ground terminals 13 are arranged, as shown in FIG. 7, the ground terminals 13 are disposed to be generally point-symmetric with respect to the signal terminal.

Figure 8:
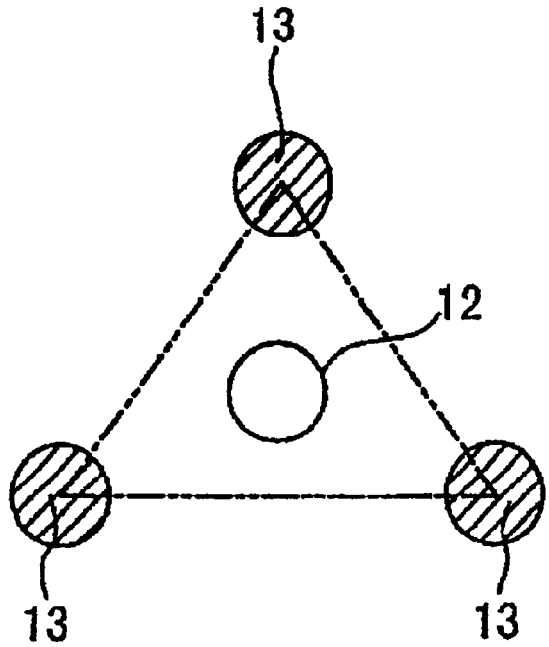
FIG. 8 is an arrangement view of pin type terminals, showing a third embodiment of the present invention.

FIG. 8 illustrates schematically an embodiment of the invention with three ground terminals 13 arranged at respective apex positions of an imaginary triangle (shown by the dashed lines in FIG. 8) and centered around the signal terminal 12.

Figure 9:
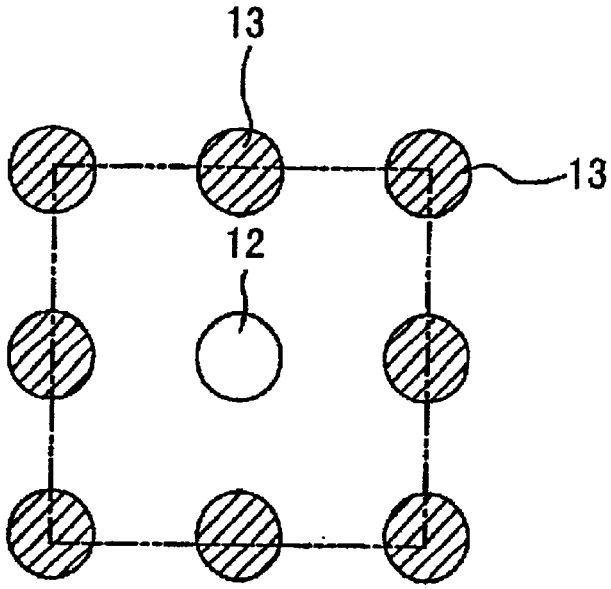
FIG. 9 is an arrangement view of pin type terminals, showing a fourth embodiment of the present invention.

In a case where eight ground terminals 13 are arranged, as shown in FIG. 9, the ground terminals are disposed, respectively, at corner portions of an imaginary square centered about the signal terminal 12 and preferably at mid-points of sides of the square.

Figure 10:
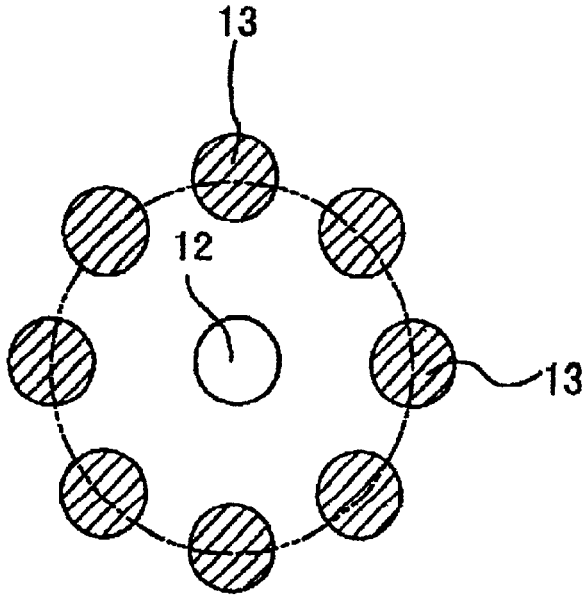
FIG. 10 is an arrangement view of pin type terminals, showing a fifth embodiment of the present invention.

In addition, in the case where eight ground terminals 13 are arranged, as shown in FIG. 10, the ground terminals may also be disposed at even angular intervals on a circle or other polygon centered about the signal terminal 12. In the case where the ground terminals are disposed at even angular intervals on a circumference in this manner, the ground terminals 13 may be five, six, seven or more. Note, however, that if the number of the ground terminals 13 is too large, the clearances between the terminals including the signal terminal 12 become too small. Therefore it is desirable to provide eight ground terminals at most.

In the embodiments, the distances between the ground terminals 13 are preferred to be equal to one another, but even if the distances are different, the similar function and effect can be obtained.

While the preferred embodiment of the invention have been shown and described, it will be apparent to those skilled in the art that changes and modifications may be made therein without departing from the spirit of the invention, the scope of which is defined by the appended claims.

What is claimed is:

1. A coaxial connector comprising: a coaxial plug provided at an end of a cable, and a coaxial receptacle electrically connected to the coaxial plug by inserting the coaxial plug therein, said coaxial plug includes a plug main body made of an insulative resin, and a plurality of terminals protruding from a planar surface of the plug main body, and the terminals are divided into one signal terminal and a plurality of ground terminals disposed around the signal terminal; and the coaxial receptacle includes an insulative housing having a surface formed with a plurality of guide holes into which the signal terminal and the ground terminals are respectively inserted, and a plurality of contacts disposed within the guide holes of the insulative housing, the contacts includes a signal contact contacted with the signal terminal and ground contacts contacted with the ground terminals, and the surface of the insulative housing has a planar portion surface-contacted with the planar surface of the coaxial plug.

2. The coaxial connector according to claim 1, wherein:

the insulative housing of the coaxial receptacle has a side surface intersecting the surface thereof; and a stopper portion is provided in a boundary portion to the planar surface of the plug main body so as to be contacted with the side surface of the insulative housing, thereby restricting a displacement of the plug main body in a direction about an axis of the signal terminal when the coaxial plug is connected to the coaxial receptacle.

3. The coaxial connector according to claim 1, wherein the ground terminals are arranged such that distances between adjacent ground terminals are set to be equal to one another.

4. The coaxial connector according to claim 1, wherein the ground terminal is arranged such that distances from the signal terminal to the ground terminals are set to be equal to one another.

5. The coaxial connector according to claim 1, wherein the signal terminal is disposed at a central portion of the planar surface, and the ground terminals are disposed around the signal terminal.

6. The coaxial connector according to claim 1, wherein two of said ground terminals are provided, which are disposed to be point-symmetric with respect to the signal terminal.

7. The coaxial connector according to claim 1, wherein three of said ground terminals are provided, which are disposed at respective apex positions of a regular triangle centered by the signal terminal.

8. The coaxial connector according to claim 1, wherein four of said ground terminals are provided, which are disposed at respective corner portions of a regular square centered by the signal terminal.

9. The coaxial connector according to claim 1, wherein eight of said ground terminals are provided, which are respectively disposed at corner portions of a regular square centered by the signal terminal and at longitudinal middle points of sides of the regular square.

10. The coaxial connector according to claim 1, wherein said terminals are perpendicular to said surface.

11. The coaxial connector according to claim 1, wherein said terminals are pin type.

* * * * *